US006614293B1

(12) United States Patent
Sauer

(10) Patent No.: US 6,614,293 B1
(45) Date of Patent: Sep. 2, 2003

(54) METHOD AND APPARATUS FOR IMPROVING CURRENT MATCHING IN AN ELECTRONIC CIRCUIT

(75) Inventor: Don R. Sauer, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 8 days.

(21) Appl. No.: 09/876,436

(22) Filed: Jun. 7, 2001

(51) Int. Cl.[7] ..... G05F 1/10
(52) U.S. Cl. ..... 327/538; 327/543
(58) Field of Search ..... 327/538, 543, 327/581, 541, 537, 530, 108

(56) References Cited

U.S. PATENT DOCUMENTS 5,055,719 A * 10/1991 Hughes ..... 327/100
6,031,416 A * 2/2000 Baschirotto et al. ..... 327/311
6,064,267 A * 5/2000 Lewyn ..... 323/315

* cited by examiner

*Primary Examiner*—Kenneth B. Wells
*Assistant Examiner*—Cassandra Cox
(74) *Attorney, Agent, or Firm*—Brett A. Hertzberg; Merchant & Gould

(57) ABSTRACT

A Sauer diode circuit is arranged to introduce a signal into a circuit to compensate for mismatch effects to various parameters in a current mirror circuit. Current matching between transistors is improved by providing matched errors such as forward current gain (Beta), early voltage, transconductance, channel-length modulation, as well as other sources of matching errors. The Sauer diode includes a series of transistors that are arranged to operate as a diode circuit that has errors that are matched to other components in an application circuit. Example application circuits include, but are not limited to reference circuits, operational amplifiers, comparators, analog-to-digital converters, digital-to-analog converters as well as other circuits that employ current mirror circuitry. The Sauer diode may be implemented in a single transistor technology such as MOS, BJT, FET, or a number of mixed technologies such as BiCMOS, BiFET and the like.

20 Claims, 6 Drawing Sheets

METHOD AND APPARATUS FOR IMPROVING CURRENT MATCHING IN AN ELECTRONIC CIRCUIT

FIELD OF THE INVENTION

The present invention relates to a method and apparatus that introduces matched errors in an electronic circuit to improve current matching performance. More specifically, the present invention is directed to a technique that improves electronic circuit performance by identifying critical points in the electronic circuit and coupling additional circuitry to the critical points in the electronic circuit to provide matched errors at the critical points.

SUMMARY OF THE INVENTION

The present invention is directed to providing a method and apparatus that improves performance in circuits that have current mirrors. More specifically the present invention is directed to providing a method and apparatus that introduces a matched error into a circuit that includes a current mirror, such that mismatches in currents in the current mirror are minimized. The current mirror with matched errors operates with low power supply voltages while maintaining reduced mismatches in the currents. The current mirror may further operate over a wide power supply range while reducing mismatch errors in the currents. A simulated diode introduces the matched errors into the current mirror such that matching performance is improved. The simulated diode counteracts the sources of matching errors such as mismatches in Beta, early voltage effects, transconductance, and channel-length modulation effects.

Briefly stated, the present invention is directed to a "Sauer diode" circuit that is arranged to introduce a signal into a circuit to compensate for mismatch effects to various parameters in a current mirror circuit. Current matching between transistors is improved by providing matched errors such as forward current gain (Beta), early voltage, transconductance, channel-length modulation, as well as other sources of matching errors. The Sauer diode includes a series of transistors that are arranged to operate as a diode circuit that has errors that are matched to other components in an application circuit. Example application circuits include, but are not limited to reference circuits, operational amplifiers, comparators, analog-to-digital converters, digital-to-analog converters as well as other circuits that employ current mirror circuitry. The Sauer diode may be implemented in a single transistor technology such as MOS, BJT, FET, or a number of mixed technologies such as BiCMOS, BiFET and the like.

In accordance with one embodiment of the present invention an apparatus is directed to an improved matching current mirror. The improved matching current mirror includes a first transistor, a second transistor, a third transistor and a Sauer diode circuit. The first transistor is of a first type, has a first operating condition, and is arranged to provide a first current. The second transistor is of the first type, has a second operating condition, and is arrnged to provide a second current that is related to the first current, wherein the first and second currents are related to one another by a non-ideal ratio that includes an error. The third transistor is of a second type, has a third operation condition, and is arranged to provide a third current in response to a signal and the second current, wherein the first and third currents are related to one another by an other non-ideal ratio. The Sauer diode circuit is arranged to produce the signal. The signal includes a proportional error that is related to the error such that the proportional error is coupled to the first transistor. The performance of the third transistor is improved by counteracting the mismatching effects of the error with the proportional error.

In accordance with another embodiment of the present invention, an apparatus is directed to improve matching in a current mirror circuit. The current mirror circuit includes a diode circuit and a transistor circuit that are arranged to operate as a current mirror. The apparatus includes a first diode means that is arranged to operate as a diode that has a similar operating condition as the diode circuit, wherein the first diode provides a first current. A first current mirror means is arranged to operate as a current mirror that has a similar operating condition as the transistor circuit, wherein the first current mirror means provides a second current that is related to the first current. A second current mirror means is arranged to produce a third current in response to the second current, wherein the third current is arranged to provide an error canceling effect on mismatches in the current mirror circuit.

In accordance with yet another embodiment of the present invention a method is directed to an improved matching current mirror circuit. The current mirror circuit includes a diode circuit and a transistor circuit that are arranged to operate as a current mirror. The method includes arranging another diode circuit to operate with an operating environment that is substantially similar to the diode circuit, arranging another transistor circuit to operate with an operating environment that is substantially similar to the transistor circuit, and reflecting a current from the another transistor circuit into the transistor circuit such that the currents in the transistor circuit match closely to the currents in the diode circuit.

In accordance with still another embodiment of the present invention an apparatus is directed to improve matching in a current mirror circuit. The apparatus includes a first transistor of a first type that is arranged to operate as a diode, the first transistor providing a first current. A second transistor of the first type is arranged to provide a second current that is related to the first current. A third transistor of a second type is arranged to conduct the first current, the third transistor being responsive to a signal at a common node. A fourth transistor of the second type is arranged to operate as a diode that conducts the current from the second transistor. A fifth transistor of the second type is arranged to provide a third current to the common node in response to the second current such that the common node operates as a terminal corresponding to a simulated diode, whereby the simulated diode is utilized to provide matched errors to the current mirror circuit such that the performance of the current mirror circuit is improved.

A more complete appreciation of the present invention and its improvements can be obtained by reference to the accompanying drawings, which are briefly summarized below, to the following detail description of presently preferred embodiments of the invention, and to the appended claims.

DETAILED DESCRIPTION OF THE PREFERRED EMBODIMENT

Throughout the specification, and in the claims, the term "connected" means a direct electrical connection between the things that are connected, without any intermediary devices. The term "coupled" means either a direct electrical connection between the things that are connected, or an indirect connection through one or more passive or active intermediary devices. The term "circuit" means one or more passive and/or active components that are arranged to cooperate with one another to provide a desired function. The term "signal" means at least one current signal, voltage signal or data signal. The meaning of "a", "an", and "the" include plural references. The meaning of "in" includes "in" and "on".

The present invention is directed to providing improved circuit performance by balancing the source of mismatches in circuit performance. In one example, the present invention matches transistor and/or diode circuit performance by providing a topology that matches errors from sources such as early voltage and beta. In another example, the present invention matches the circuit performance of MOS transistors and diodes by matching errors that are due to channel-length modulation effects. Temperature and other sources of errors can also be matched using the balanced circuit approach.

Figure 1:
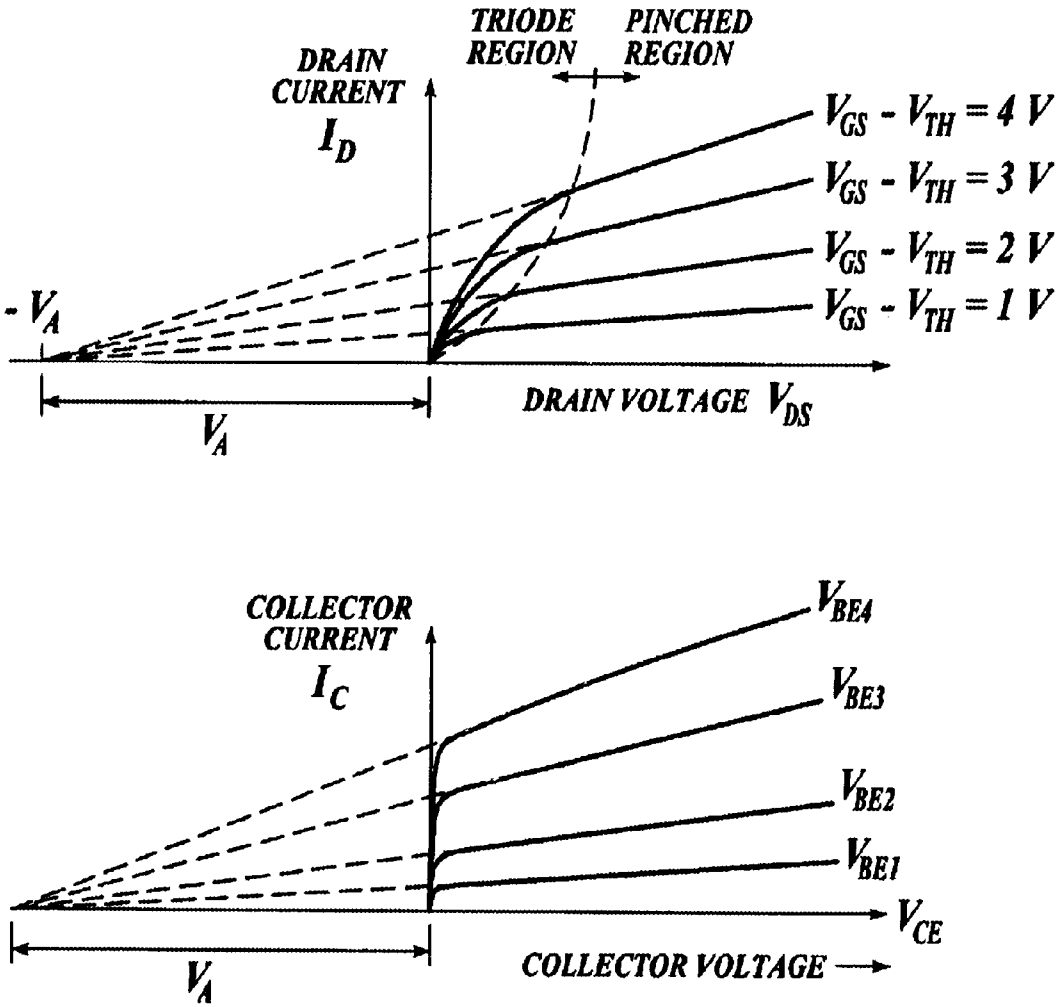
FIG. 1 is a graph illustrating variations in the current in transistors due to various parameters.

FIG. 1 illustrates the collector current (IC) for a bipolar junction transistor as a function of the base-emitter voltage (VBE) and the collector-emitter voltage (VCE). The collector current (IC) for a forward biased bipolar junction transistor (BJT) may generally be described as $IC=ISAT*e^{VBE/VT}$, where ISAT is the saturation current, VBE is the base-emitter voltage, and VT is the thermal voltage. An approximation of the base-emitter voltage is given as VBE=VT*ln(IC/ISAT). However, the early voltage (VA) of the transistor modifies the collector current (IC) equation to account for changes in the collector-emitter voltage (VCE) across the transistor such that $IC=ISAT*(1+VCE/VA)*e^{VBE/VT}$. As shown in FIG. 1, the collector current (IC) in a bipolar device varies with changes in the collector-emitter voltage (VCE) due to the early voltage (VA). The variation of the collector current due to the collector-emitter voltage is known as the early effect. Inspecting the collector current equation above reveals that the collector current (IC) changes over temperature due to the thermal voltage (VT) which is given as k*T/q, where k is Boltzman's constant, T is temperature in degrees Kelvin, and q is the change of an electron.

FIG. 1 also illustrates the drain current (ID) in a metal oxide semiconductor field effect transistor (MOSFET) as a function of the drain-source voltage (VDS), the gate-source voltage (VGS), and the threshold potential (VTH). For a saturated MOSFET, the drain current (ID) may generally be described as $ID=K'*(W/L)*(VGS-VTH)^2$, where K' is determined by process dependent constants, W is the effective channel width, and L is the effective channel length. For a given sized device (fixed W/L), the drain current (ID) appears to be purely dependent on the gate-source voltage (VGS) and the threshold potential (VTH). However, a more accurate model of the drain current includes a channel-length modulation effect (λ), which changes the efficiency of the drain current based on the drain-source voltage, as given by $ID=K'*(W/L)*(1+\lambda*VDS)*(VGS-VT)^2$. The channel-length modulation effect (λ) results in an intercept (VA) on the voltage axis of the current-voltage characteristic graph as illustrated in FIG. 1.

An analog building block such as a current mirror can be simply arranged as an NPN type BJT that is diode-connected (base and collector shorted, together) and arranged to have a common base and common emitter with another NPN type BJT transistor. Assuming the transistors are a matched pair that are sized identically, the transistors should have the same collector current since $IC=ISAT*e^{VBE/VT}$, and ISAT, VBE and VT are matched for the pair of transistors. However, since the diode-connected transistor, has a collector-emitter voltage that is equal to its base-emitter voltage, and the non-diode connected transistor has a collector that is not necessarily matched to the base voltage, the currents will not match. One reason the currents will not match is due to the early effect as described above. Another reason is that the forward gain (Beta), and the VBE of the transistors may not perfectly match. An MOS type of current mirror may be arranged similar to the BJT type just described. In this case, the channel length modulation affects the MOS transistor pair similar to the early voltage in a BJT transistor, such that the drain currents do not match since the drain-source voltages are mismatched. Any one of a number of non-ideal effects may result from the operating conditions on each transistor as illustrated above. Thus, the matching performance of a current mirror will be affected by the operating conditions for each transistor.

One conventional solution attempts to minimize the mismatches in the collector-emitter voltage (or the drain-source voltage for MOS) in the matched pair by connecting a series element to the collector of the non-diode connected transistor. The series element is usually a transistor that is often referred to as a "cascode" transistor. This "cascode" transistor is arranged to lower the collector voltage of the matching transistor such that the diode-connected transistor and the matching transistor have closely comparable collector-emitter voltages. In theory, the closer the matching between the collector-emitter voltages, the lower the matching error in the collector currents will be.

The present invention departs from the use of cascode current sources, and other notions that require the absolute tolerances of matching to be strictly adhered to. Instead, the present invention intentionally introduces an error into a given circuit arrangement such that the amount of error introduced provides a matched amount of error in the overall circuit. The overall circuit performance is improved by matching the errors with a Sauer diode. Low voltage operation is improved by eliminating the dependency on cascode devices such that fewer devices are connected in series between the power supply rails. The Sauer diode may be utilized in any circuit that requires a matched or scaled current such as, for example, a voltage reference circuit, an amplifier or comparator circuit, an analog-to-digital or digital-to-analog circuit, as well as others.

Figure 2:
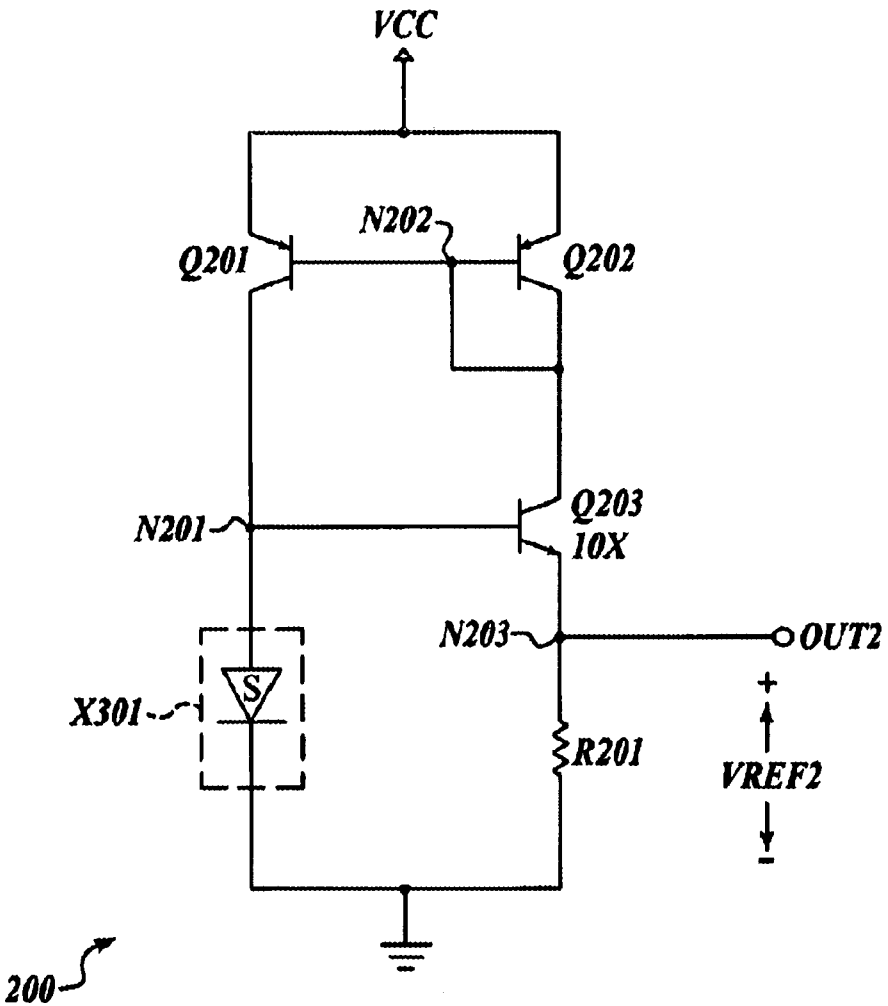
FIG. 2 is a schematic diagram illustrating an exemplary application including a Sauer diode.

An example application of the present invention is illustrated as a reference circuit (200) as shown in FIG. 2. The reference circuit (200) includes three transistors (Q201–Q203), a resistor (R201) and a diode circuit (X301). The diode circuit (X301) is arranged to provide a matched error to other non-ideal effects in the remainder of the circuit as will be discussed later.

Transistor Q201 is a PNP rnsistor that has an emitter coupled to a positive power supply potential (VCC), a base coupled to node N202 and a collector coupled to node N201. Transistor Q202 is a PNP transistor that has an emitter coupled to the positive power supply potential (VCC), a base coupled to node N202, and a collector coupled to node N202. Transistor Q203 is an NPN transistor that has an emitter coupled to node N202, a base coupled to node N201, and a collector coupled to node N202. Resistor R201 is coupled between node N203 and a circuit ground potential (GND). Diode circuit (X301) is coupled between node N201 and the circuit ground potential (GND). An output port (OUT2) is coupled to node N203. As will be discussed later, diode circuit X301 is a circuit [has] that is arranged to operate as an error matching diode, hereinafter referred to as a "Sauer diode".

In operation, node N203 may provide a reference voltage signal (VREF2) to another circuit through the output port (OUT2). Transistors Q201 and Q202 are a first matched pair of transistors that are configured as a simple current mirror, with common base-emitter voltages. Ideally, the collector current of transistors Q201 and Q202 match each other. Transistor Q203 is a 10× device with respect to the Sauer diode (X301) such that the current density of Q203 is substantially 1/10 of the current density in the Sauer diode (X301). The difference in the current density of the transistor Q203 and Sauer diode results in a difference in the base-emitter voltage of transistor Q203 and the diode voltage associated with the Sauer diode (X301). The difference between the voltages appears across resistor R201. When the scaling between Q203 and Sauer diode X301 are closely matched, the reference voltage signal (VREF2) is roughly 60 mV. The reference circuit (200) described above may be referred to as a "band-gap" reference circuit However, reference circuit 200 differs from a conventional reference circuit in that a Sauer diode (X301) that is arranged in accordance with the present invention is utilized in place of a conventional diode.

Figure 3:
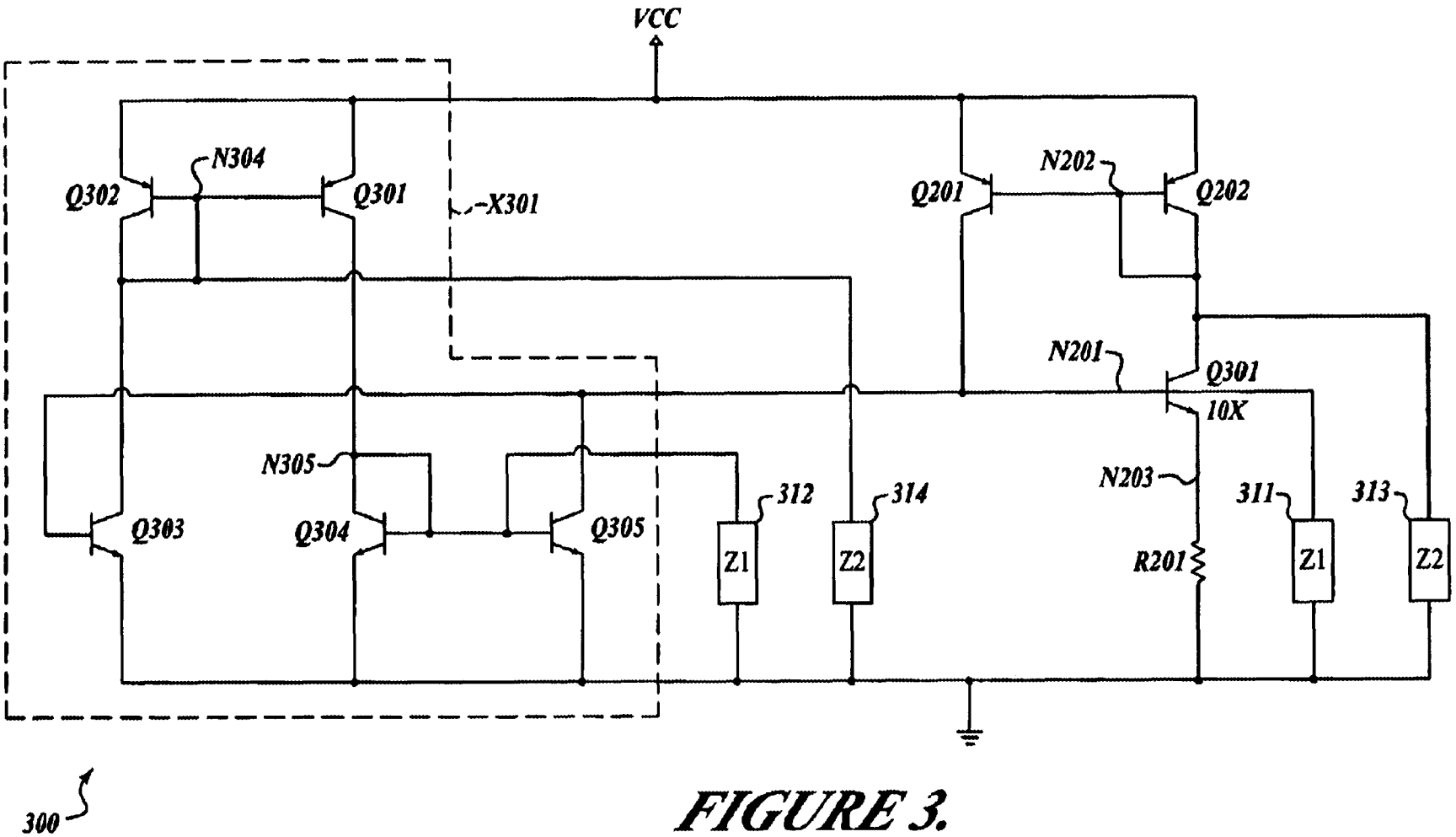
FIG. 3 is a schematic diagram illustrating another exemplary application of a Sauer diode.

FIG. 3 illustrates a reference circuit (300) that includes a detailed schematic of the Sauer diode (X301). The reference voltage circuit (300) includes eight transistors (Q201–Q203, Q301–Q305), a resistor (R201), and four optional load circuits (311–314). Identical components from FIG. 2 are labeled and connected identically in FIG. 3. The discussion regarding the arrangement of transistors Q201–Q203, and resistor R201 is identical to that which has been described with respect to FIG. 2.

Transistor Q301 is a PNP transistor that has an emitter coupled to the positive power supply potential (VCC), a base coupled to node N304 and a collector coupled to node N305. Transistor Q302 is a PNP transistor that has an emitter coupled to the positive power supply potential (VCC), a base coupled to node N304, and a collector coupled to node N304. Transistor Q303 is an NPN transistor that has an emitter coupled to the circuit ground potential (GND), a base coupled to node N201, and a collector coupled to node N304. Transistor Q304 is an NPN transistor that has an emitter coupled to the circuit ground potential (GND), a base coupled to node N305, and a collector coupled to node N305. Transistor Q305 is an NPN transistor that has an emitter coupled to the circuit ground potential (GND), a base coupled to node N305, and a collector coupled to node N201.

The reference circuit (300) illustrated in FIG. 3 is a band-gap reference circuit as previously described with regards to FIG. 2. The transistors in the Sauer diode circuit (X301) operate as a simulated diode circuit that intentionally introduces errors into the circuit at node N201. The errors that are introduced into node N201 are matched to errors that are inherently present in the remaining electronic components of the reference circuit (300). In this exemplary circuit, the errors that are intentionally introduced into node N201 are devised to produce closely matched currents in the current mirror formed by transistors Q201 and Q202.

As discussed previously, mismatches in the early voltage and the Beta in matching or scaled BJTs may result in poorly matched or scaled currents. For example, when a conventional diode is used in place of the Sauer diode (X301), the collector-emitter voltage of Q201 and Q202 will not match one another. Due to the early effect a mismatch in the collector-emitter voltage of transistors Q201 and Q202 will result in a mismatch in the collector current as previously discussed. Also, a mismatch in the Beta of transistors Q201 and Q202 will further cause a mismatch in the collector currents of transistors Q201 and Q202.

To minimize the early effect, beta mismatch, and other mismatched parameters between transistors (e.g., Q201 and Q202), the Sauer diode (X301) is arranged to introduce proportional amounts of errors into node N201. The early voltage and beta effects on transistor Q201 are matched to the early voltage and beta effects on transistor Q301. Similarly, the early voltage and beta effects on transistors Q202 and Q302 are matched, while the early voltage and beta effect on transistors Q203 and Q303 are matched. Transistor Q304 and Q305 are operated in a current mirror arrangement. Transistor Q305 is arranged to operate as a simulated diode that intentionally introduces matched errors (i.e., early voltage effect, and beta mismatch) into node N201.

The transistors in the Sauer diode (X301) are arranged to introduce matched errors to counteract matching errors in the current mirror circuit formed by transistors Q201 and Q202. For example, a mismatch error between transistor Q201 and Q202 match the mismatch error between transistor Q301 and Q302. The remaining circuitry introduces this mismatch error into node N201. Similarly, a mismatch between transistors Q203 and the Sauer diode (X301) are counteracted by the arrangement of transistors Q303 and Q305, which track the impetus of the error (i.e., beta error, early effect, Vbe, etc.).

The reference circuit (300) depicted in FIG. 3 can be used to produce one or more reference signals. In one example, the base connection of transistor Q203 at node N201 may be used as a first reference signal. The first reference signal may operate as a reference voltage, a biasing signal, or any other suitable reference signal as may be required in an electronic system. A first load element (311) is coupled between the base terminal at node N201 and the circuit ground potential (GND). The first load element has a corresponding impedance (Z1). Since the base of transistor Q203 is loaded with an impedance (Z1), another load element (312) that has the same corresponding impedance (Z1) must be coupled to the base of transistor Q305. By matching the impedance on the base of transistors Q305 and Q203, any error introduced due to the load is matched. The load element represents an effective input impedance of another circuit such as, for example, another NPN transistor that is biased with a common base connection to transistor Q203.

In another example, the base connection of transistor Q202 at node N202 may be used as a second reference signal. The second load element (313) is coupled between the base terminal at node N202 and the circuit ground potential (GND). The second load element has another corresponding impedance (Z2). Since the base of transistor Q202 is loaded with an impedance (Z2), another load element (314) that has the same corresponding impedance (Z2) must be coupled to the base of transistor Q305. By matching the loading on the base of transistors Q301 and Q202, any error introduced due to the load is matched. The load element represents an effective input impedance of another circuit such as, for example, another NPN transistor that is biased in common with Q203. Although not shown, loading effects in other circuit configurations can also be counteracted by a matched loading effect in the Sauer diode circuit (i.e., X301).

Figure 4:
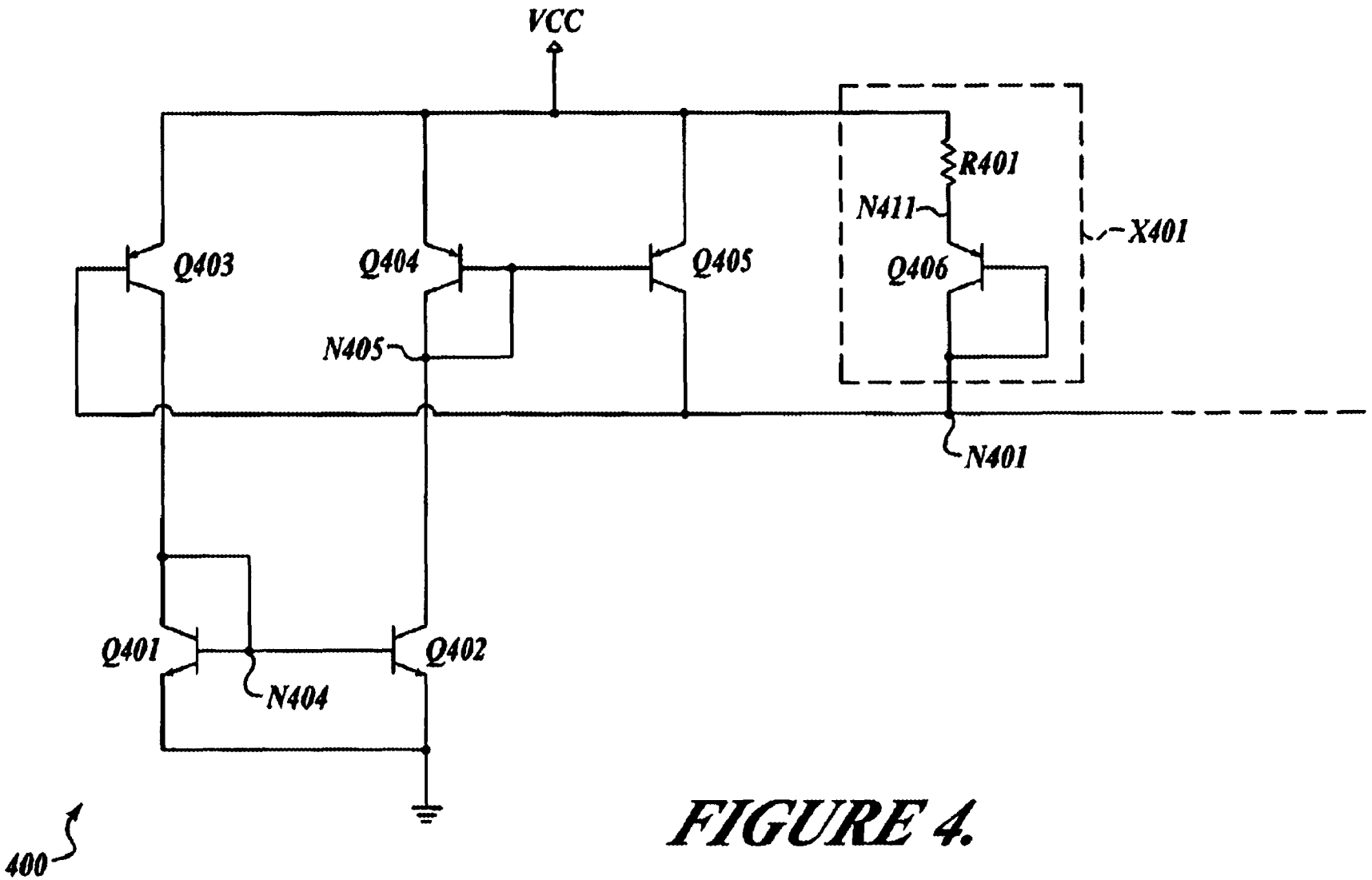
FIG. 4 is a schematic diagram illustrating an exemplary Sauer diode.

FIG. 4 illustrates another exemplary "Sauer diode" circuit (400) that is in accordance with the present invention. The "Sauer diode" circuit (400) includes five transistors (Q401–Q405), and an optional gain scaling circuit (X401). The optional gain scaling circuit (X401) includes a transistor (Q406) and a resistor (R401).

Transistor Q401 is an NNP transistor that has an emitter coupled to the circuit ground potential (GND), a base coupled to node N404, and a collector coupled to node N404. Transistor Q402 is an NPN transistor that has an emitter coupled to the circuit ground potential, a base coupled to node N404, and a collector coupled to node N405. Transistor Q403 is a PNP transistor that has an emitter coupled to the positive power supply potential (VCC), a base coupled to node N401, and a collector coupled to node N404. Transistor Q404 is a PNP transistor that has an emitter coupled to the positive power supply potential (VCC), a base coupled to node N405, and a collector coupled to node N405. Transistor Q405 is a PNP transistor that has an emitter coupled to the positive power supply potential (VCC), a base coupled to node N405, and a collector coupled to node N401. The gain scaling circuit is coupled between node N401 and the positive power supply potential (VCC). Transistor Q401 is a PNP transistor that has an emitter coupled to node N411, a base coupled to node N401, and a collector coupled to node N401. Resistor R401 is coupled between node N401 and the positive power supply potential (VCC).

The Sauer diode (400) illustrated in FIG. 4 is basically a "flipped over" version of the Sauer diode (X301) illustrated in FIG. 3. In light of the above disclosure, a person of ordinary skill in the art would appreciate and understand that the operation of transistors Q401–Q405 is substantially similar to the operation of transistors Q301–Q305. Thus, the aspects of balanced loading and general utility of the "Sauer diode" are the same as previously discussed. However, the optional gain scaling circuit (X401) allows for an adjustment factor for the "Sauer diode".

The gain scaling circuit (X401) is arranged to scale the effects of the Sauer diode (400) such that the matching of errors is somewhere between a Sauer diode and a regular diode. In one example, resistor R401 is eliminated and the area of the diode device (Q406) will determine the scaling factor relative to the Sauer diode. It is common practice to provide current biasing using a band-gap reference circuit. In a band-gap biased circuit, the voltage drop across all of the resistors will track kT/q. For bipolar junction diodes, the voltage drop across a resistor in series with a diode can be used in place of an area scaled diode. Resistor R401 and diode-connected transistor Q406 are arranged in parallel with a Sauer diode as shown in FIG. 4 to illustrate a scaled diode. A MOS transistor will operate similarly when configured to operate as a sub-threshold device.

Figure 5:
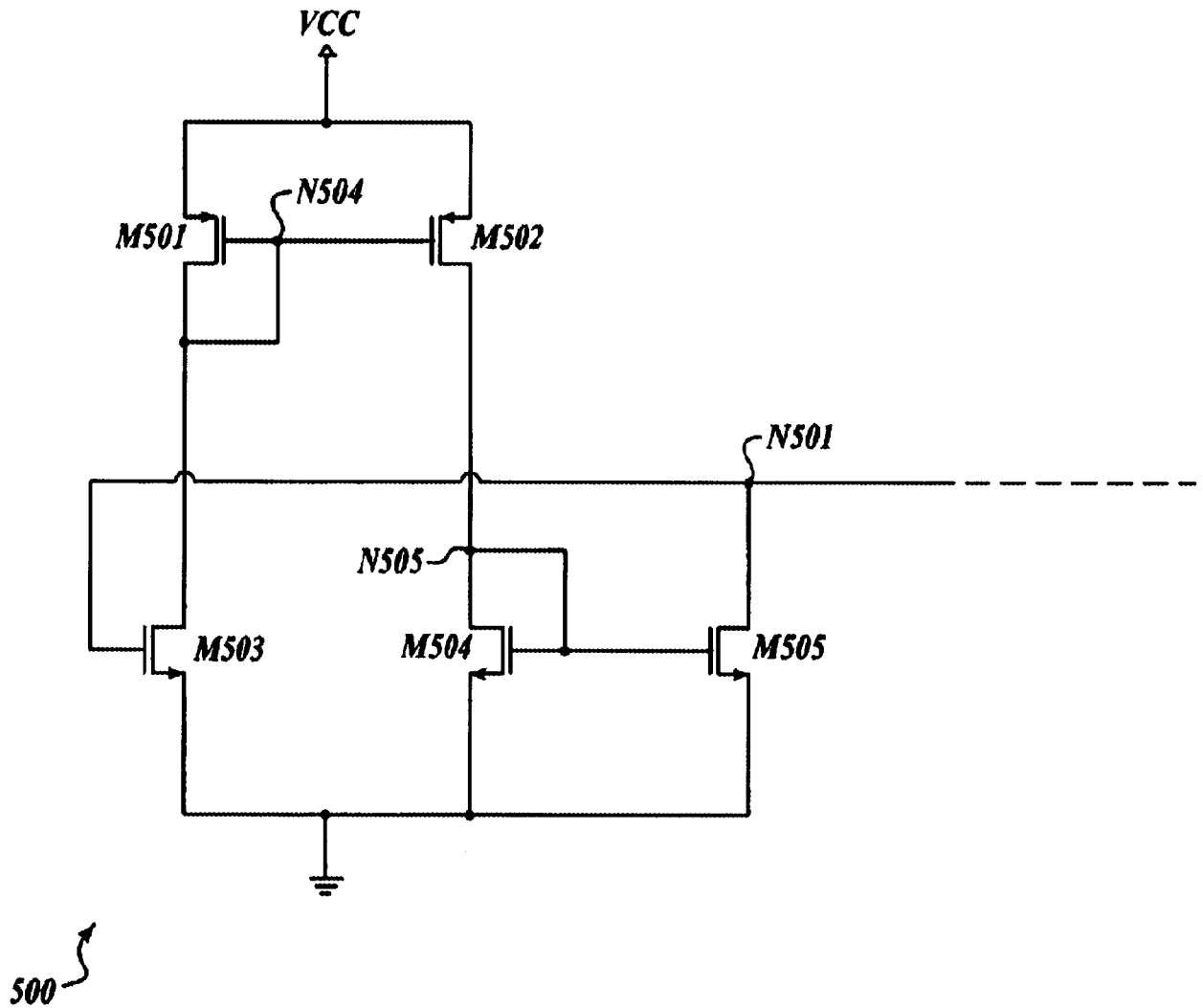
FIG. 5 is a schematic diagram illustrating another exemplary Sauer diode.

FIG. 5 illustrates another exemplary "Sauer diode" circuit (500) that is in accordance with the present invention. The "Sauer diode" circuit (500) includes five transistors (M501–M505).

Transistor M501 is a PMOS transistor that has a drain coupled to node N504, a gate coupled to node N504, and a source coupled to the positive power supply potential (VCC). Transistor M502 is a PMOS transistor that has a drain coupled to node N505, a gate coupled to node N504, and a source coupled to the positive power supply potential (VCC). Transistor M503 is an NMOS transistor that has a drain coupled to node N504, a gate coupled to node N501, and a source coupled to a circuit ground potential (GND). Transistor M504 is an NMOS transistor that has a drain coupled to node N505, a gate coupled to node N505, and a source coupled to a circuit ground potential (GND). Transistor M505 is an NMOS transistor that has a drain coupled to node N501, a gate coupled to node N505, and a source coupled to a circuit ground potential (GND).

The "Sauer diode" circuit (500) shown in FIG. 5 is a MOS version of the "Sauer diode" circuit (X300) shown in FIG. 3 In light of the above disclosure, one of ordinary skill in the art will understand and appreciate that the operation of the "Sauer diode" circuit (500) is substantially similar to the operation of the "Sauer diode" circuit (X301) shown in FIG. 3. Thus, the "Sauer diode" circuit operates as an error matching diode between node N501 and the circuit ground potential. Instead of matching the early voltage as in the case of a bipolar junction transistor, the above-described circuit (500) provides for error matching in the channel-length modulation effect as well as matching other operating parameters such as transconductance.

Transistors M501 and M502 are arranged to operate as a current mirror. Transistors M504 and M505 are also arranged to operate as a current mirror. Transistor M503 is arranged to match a critical transistor in an application circuit (not shown). Most any application circuit that has a current mirror circuit that has mismatch problems that would benefit from the above-described methods.

Although FIGS. 3–5 illustrate Sauer diode circuits that contain one type of transistor technology (e.g., MOS, BJT), the Sauer diode topology may be applied to mixed technologies with more than one type of transistor technology. For example, a Sauer diode arrangement may be implemented in a BiCMOS or BiFET technology where one or more of the current mirror arrangements may be different transistor types. In addition, although FIG. 3 illustrates an application of the Sauer diode in a reference circuit, the concepts are equally applicable to other circuits where the performance of a particular circuit relies upon matching of currents (or current densities). Some example applications that are within the scope of the present invention include digital-to-analog and analog-to-digital converters (DACs/ADCs), operational amplifier, comparators, and other circuits, as is understood in light of the above disclosure.

Figure 6:
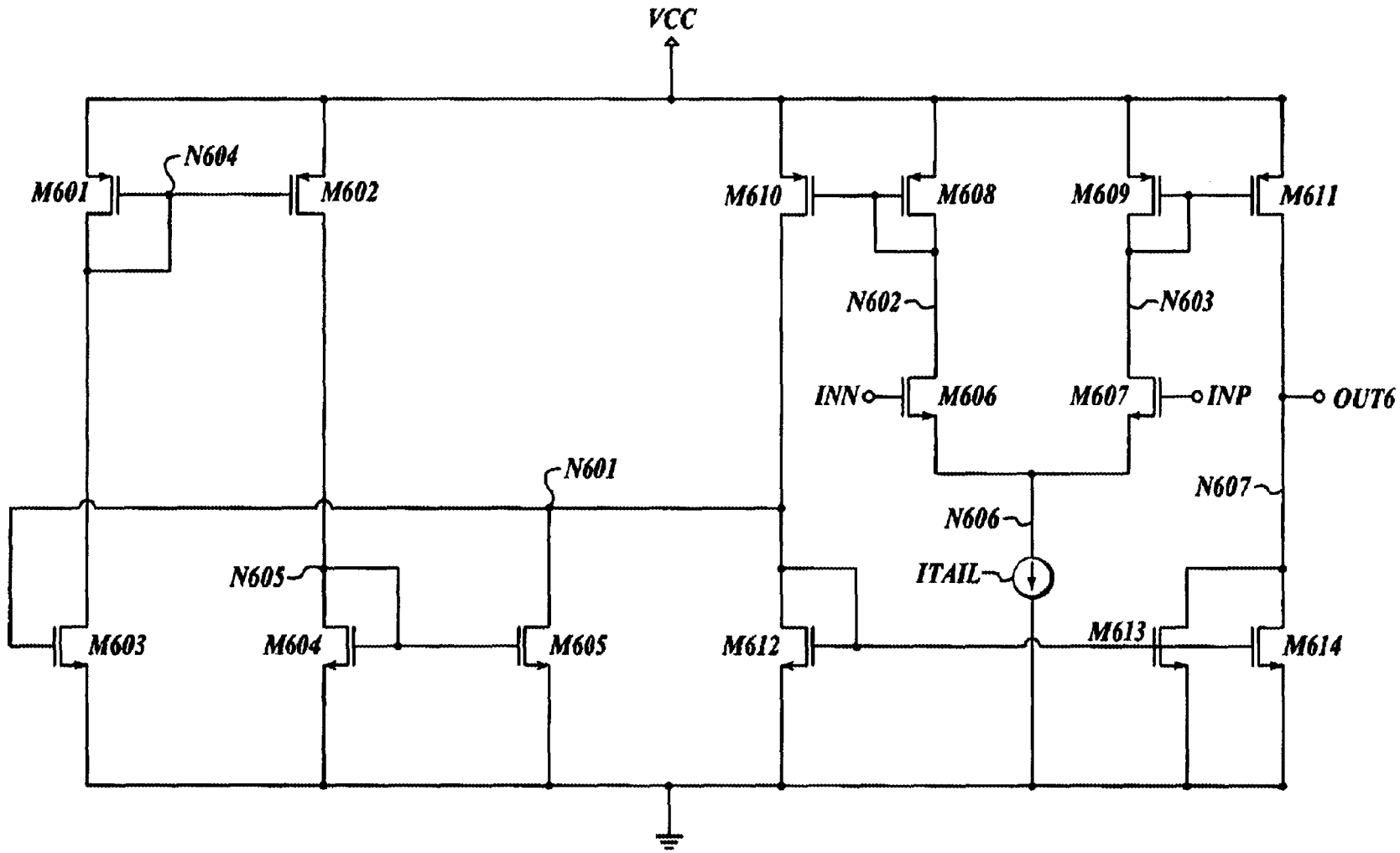
FIG. 6 is a schematic diagram illustrating another exemplary application including a Sauer diode.

FIG. 6 illustrates another exemplary application of a "Sauer diode" circuit in a transconductance amplifier circuit (600). The transconductance amplifier circuit (600) includes fourteen transistors (M601–M614) and a current source (ITAIL).

Transistor M601 is a PMOS transistor that has a drain coupled to node N604, a gate coupled to node N604, and a source coupled to the positive power supply potential (VCC). Transistor M602 is a PMOS transistor that has a drain coupled to node N605, a gate coupled to node N604, and a source coupled to the positive power supply potential (VCC). Transistor M603 is an NMOS transistor that has a drain coupled to node N604, a gate coupled to node N601, and a source coupled to a circuit ground potential (GND). Transistor M604 is an NMOS transistor that has a drain coupled to node N605, a gate coupled to node N605, and a source coupled to a circuit ground potential (GND). Transistor M605 is an NMOS transistor that has a drain coupled to node N601, a gate coupled to node N605, and a source coupled to a circuit ground potential (GND). Transistor M606 is an NMOS transistor that has a drain coupled to node N602, a gate coupled to an input terminal (INN), and a source that is coupled to node N606. Transistor M607 is an NMOS transistor that has a drain coupled to node N603, a gate coupled to another input terminal (INP), and a source that is coupled to node N606. Transistor M608 is a PMOS transistor that has a drain and gate coupled to node N602, and a source coupled to the positive power supply potential (VCC). Transistor M609 is a PMOS transistor that has a drain and gate coupled to node N603, and a source coupled to the positive power supply potential (VCC). Transistor M610 is a PMOS transistor that has a drain coupled to node N601, a gate coupled to node N602, and a source coupled to the positive power supply potential (VCC). Transistor M611 is a PMOS transistor that has a drain coupled to node N607, a gate coupled to node N603, and a source coupled to the positive power supply potential (VCC). Transistor M612 is a PMOS transistor that, has a drain and gate coupled to node N601, and a source coupled to the circuit ground potential (GND). Transistors M613 and M614 are PMOS transistors that have drains coupled to node N607, gates connected to node N601, and sources coupled to the circuit ground potential (GND). Current source ITAIL is coupled between node N606 and the circuit ground potential (GND). An output terminal (OUT6) is coupled to node N607.

Transistors M606–M614 and current source ITAIL are arranged as a transconductance amplifier that produces an output signal at the OUT6 terminal in response to a differential signal that is applied across the INP and INN terminals. Transistors M608 and M609 are diode-connected devices that are load devices in the differential amplifier input stage that is formed by transistors M606 and M607 and current source ITAIL. Since the input stage has a balanced load, any offsets present in the input stage should be minimized. Transistor M610 and M608 form a first current mirror, while transistors M609 and M611 form another current mirror. However, if the drain-source voltage (VDS) of transistors M610 and M611 are not closely matched, the transconductance amplifier (600) will have an offset associated with the mismatch in the current due to the channel-length modulation effect, and other mismatched parameters as previously discussed. Since transistor M612 and M614 are arranged a current mirror, with M612 configured as a diode device, transistors M612 and M614 will not have comparable drain-source voltages. A Sauer diode (transistors M601–M605) is coupled to node N601 to introduce matched errors to improve the performance of the transconductance amplifier (600).

The Sauer diode shown in FIG. 6 is substantially the same as the Sauer diode shown in FIG. 5. Transistor M601 and M602 have mismatch errors that are comparable to mismatches in transistors M610 and M608. Transistor M612 is a diode-connected device that is in parallel with the Sauer diode. To match the operation of these two parallel diodes, transistor M613 is included in parallel with transistor M614. Transistor M603 and M612 are connected with common gate and source connections such that their gate-source voltages match. However, the drain current in transistor M612 will mismatch the drain current in transistor M603 due to the channel length modulation effect since their drain-source voltages do not match (note that M603 is coupled to M612, which is a diode connected device). Ideally, the currents in transistors M601 and M602 match, as would the currents in transistors M604 and M605. However, due to the errors in matching due to the parameters previously described (e.g., transconductance, channel-length modulation, etc.), transistor M605 will have a drain current that is mismatched with respect to the drain current in transistor M604. The amount of error inherent in the mismatch between M605 and M604 tracks the mismatch in transistor present in the transconductance amplifier.

The above specification, examples and data provide a complete description of the manufacture and use of the composition of the invention. Since many embodiments of the invention can be made without departing from the spirit and scope of the invention, the invention resides in the claims herein after appended.

I claim:

1. An apparatus that has an improved matching current mirror, comprising:

a first transistor of a first type has a first operating condition and is arranged to provide a first current;

a second transistor of the first type has a second operating condition and is arranged to provide a second current that is related to the first current, wherein a mismatch between the first and second currents due to non-ideal effects of the first and second operating conditions results in an error;

a third transistor of a second type has a third operating condition and is arranged to provide a third current in response to a signal and the second current; and a Sauer diode circuit that is arranged to produce the signal, wherein the first, second, and third operating conditions are matched by the Sauer diode circuit, and wherein the signal includes a proportional error signal that is related to the error such that the proportional error signal is coupled to the first transistor, whereby performance of the third transistor is improved by counteracting the mismatching effects of the error with the proportional error signal.

2. An apparatus as in claim 1, the Sauer diode circuit further comprising:

a fourth transistor of the first type has a fourth operating condition and is arranged to provide a fourth current, wherein the fourth operating condition is comparable to the first operating condition;

a fifth transistor of the first type has a fifth operating condition and is arranged to provide a fifth current that is related to the fourth current, wherein the fifth operating condition is comparable to the second operating condition;

a sixth transistor of the second type has a sixth operating condition and is arranged to conduct the fifth current, wherein the third operating condition is comparable to the sixth operating condition; and a seventh transistor of the second type is arranged to produce the signal in response to the fourth current, wherein the signal provides the proportional error signal.

3. An apparatus as in claim 2, wherein the third transistor and the seventh transistor have matched loading conditions.

4. An apparatus as in claim 2, wherein the second transistor and the fifth transistor have matched loading conditions.

5. An apparatus as in claim 2, further comprising a scaling circuit that is arranged to scale the effects of the Sauer diode circuit by a scaling factor.

6. An apparatus as in claim 5, the scaling circuit further comprising an eighth transistor of the second type that is arranged to operate as a diode in series with a resistor.

7. An apparatus as in claim 1, wherein the first second and third transistors are part of a current mirror in at least one of an amplifier circuit, a reference circuit, and a current scaling digital-to-analog converter.

8. An apparatus that improves matching in a current mirror circuit, the current mirror circuit including a diode circuit and a transistor circuit that are arranged to operate as a current mirror, the apparatus comprising:

a first diode means that is arranged to operate as a diode that has a similar operating condition as the diode circuit, wherein the first diode means provides a first current;

a first current mirror means that is arranged to operate as a current mirror in cooperation with the first diode means such that the current mirror has a similar operating condition as the transistor circuit, wherein the first current mirror means provides a second current that is related to the first current; and a second current mirror means that is arranged to produce a third current in response to the second current, wherein the third current is arranged to provide an error canceling effect on mismatches in the current mirror circuit.

9. An apparatus as in claim 8, wherein the error canceling effect is effective to cancel the mismatches from at least one of forward-gain, early voltage, channel-length modulation, and transconductance.

10. A method of improving performance in an apparatus that includes a current mirror circuit, the current mirror circuit including a diode circuit and a transistor circuit that are arranged to operate as a current mirror, wherein the diode circuit provides a first current and the transistor circuit provides a second current, the method comprising:

arranging another diode circuit to operate with an operating environment that is substantially similar to the diode circuit;

arranging another transistor circuit to operate with an operating environment that is substantially similar to the transistor circuit, wherein the another transistor circuit provides a third current; and arranging another current mirror circuit to reflect the third current from the another transistor circuit to provide a fourth current to the transistor circuit such that the second current and the fourth current are combined to match closely to the first current.

11. An apparatus as in claim 10, wherein the reflecting the current from the another transistor circuit into the transistor circuit reduces the mismatches in the current mirror circuit that include at least one of transconductance mismatches, channel-length modulation effects due to drain-source potential mismatches, threshold voltage mismatches, beta mismatches, early voltage effects due to collector-emitter voltage mismatches, and base-emitter voltage mismatches.

12. An apparatus that improves matching in a current mirror circuit, comprising:

a first transistor of a first type that is arranged to operate as a diode, the first transistor providing a first current;

a second transistor of the first type that is arranged to provide a second current that is related to the first current;

a third transistor of a second type that is arranged to conduct the first current, the third transistor being responsive to a signal at a common node;

a fourth transistor of the second type that is arranged to operate as a diode that conducts the current from the second transistor; and a fifth transistor of the second type that is arranged to provide a third current to the common node in response to the second current such that the common node operates as a terminal corresponding to a simulated diode, whereby the simulated diode is utilized to provide matched errors to the current mirror circuit such that the performance of the current mirror circuit is improved.

13. An apparatus as in claim 12, wherein the first, second, third, fourth, and fifth transistors are transistors types that are at least one of MOS, JFET, BJT, and GaAsFET.

14. An apparatus as in claim 12, wherein the first transistor is a PNP transistor that has a base and collector connected to a first node, the second transistor is a PNP transistor that has a base connected to the first node and a collector connected to a second node, the third transistor is an NPN transistor that has a collector connected to the first node and a base connected to the common node, the fourth transistor is an NPN transistor that has a collector and base connected to the second node, and the fifth transistor is an NPN transistor that has a collector connected to the common node and a base connected to the second node.

15. An apparatus as in claim 12, wherein the first transistor is an NPN transistor that has a base and collector connected to a first node, the second transistor is an NPN transistor that has a base connected to the first node and a collector connected to a second node, the third transistor is a PNP transistor that has a collector connected to the first node and a base connected to the common node, the fourth transistor is a PNP transistor that has a collector and base connected to the second node, and the fifth transistor is a PNP transistor that has a collector connected to the common node and a base connected to the second node.

16. An apparatus as in claim 12, wherein the first transistor is a p-type FET that has a gate and drain connected to a first node, the second transistor is a p-type FET that has a gate connected to the first node and a drain connected to a second node, the third transistor is an n-type FET that has a drain connected to the first node and a gate connected to the common node, the fourth transistor is an n-type FET that has a drain and gate connected to the second node, and the fifth transistor is an n-type FET that has a drain connected to the common node and a gate connected to the second node.

17. An apparatus as in claim 12, wherein the first transistor is a n-type FET that has a gate and drain connected to a first node, the second transistor is a n-type FET that has a gate connected to the first node and a drain connected to a second node, the third transistor is a p-type FET that has a drain connected to the first node and a gate connected to the common node, the fourth transistor is a p-type FET that has a drain and gate connected to the second node, and the fifth transistor is a p-type FET that has a drain connected to the common node and a gate connected to the second node.

18. An apparatus as in claim 12, wherein the first transistor and the second transistor have operating conditions that are similar to operating conditions in the current mirror circuit such that the errors caused by mismatches in the current mirror circuit are minimized by coupling the common node to the current mirror.

19. An apparatus as in claim 12, wherein the first transistor and the second transistor have current scaling errors sources that are matched to the other current scaling error sources in other transistors of the current mirror circuit such that the current scaling errors track the other current scaling errors over all operating conditions.

20. An apparatus as in claim 19, wherein the current scaling error sources include at least one of transconductance mismatches, channel-length modulation effects due to drain-source potential mismatches, threshold voltage mismatches, beta mismatches, early voltage effects due to collector-emitter voltage mismatches, and base-emitter voltage mismatches.

* * * * *

UNITED STATES PATENT AND TRADEMARK OFFICE

CERTIFICATE OF CORRECTION

PATENT NO. : 6,614,293 B1
DATED : September 2, 2003
INVENTOR(S) : Don R. Sauer

It is certified that error appears in the above-identified patent and that said Letters Patent is hereby corrected as shown below:

Column 1,
Line 56, "and is arrnged to provide" should read -- and is arranged to provide --
Line 60, "has a third operation condition" should read -- has a third operating condition --

Column 4,
Line 54, "is a PNP rnsistor that has" should read -- is a PNP transistor that has --
Line 67, "is a circuit has that is arranged" should read -- is a circuit that is arranged --

Column 10,
Line 38, "wherein the first second and third transistors" should read -- wherein the first, second, and third transistors --

Column 11,
Line 16, "wherein the reflecting the current" should read -- wherein the reflecting current --

Signed and Sealed this

Seventeenth Day of February, 2004

JON W. DUDAS
*Acting Director of the United States Patent and Trademark Office*